US007074169B2

(12) United States Patent
Hristov

(10) Patent No.: US 7,074,169 B2
(45) Date of Patent: Jul. 11, 2006

(54) WHEEL-GUIDING DEVICE AND METHODS OF USE THEREOF

(76) Inventor: Vasil T. Hristov, 31 Wedgefield Dr., Asherville, NC (US) 28806

( * ) Notice: Subject to any disclaimer, the term of this patent is extended or adjusted under 35 U.S.C. 154(b) by 0 days.

(21) Appl. No.: 10/419,641

(22) Filed: Apr. 22, 2003

(65) Prior Publication Data

US 2004/0214695 A1 Oct. 28, 2004

(51) Int. Cl.
*A63B 71/00* (2006.01)

(52) U.S. Cl. ..... 482/148; 482/98; 482/99; D21/198; D21/191; 280/205; 208/182

(58) Field of Classification Search ..... D21/198, D21/191, 192, 196, 195, 197; 482/98, 99, 482/92, 93, 94, 148, 132; 280/205; 208/182
See application file for complete search history.

(56) References Cited

U.S. PATENT DOCUMENTS 2,748,533 A * 6/1956 Cipolla ..... 446/453
3,605,333 A * 9/1971 Copeland ..... 446/453
4,102,077 A * 7/1978 Marino ..... 446/453
4,911,675 A * 3/1990 Rogers ..... 446/267
4,913,677 A * 4/1990 Brasier et al. ..... 446/453
5,299,970 A * 4/1994 Fontaine ..... 446/453
5,679,051 A * 10/1997 Oner et al. ..... 446/411
5,730,639 A * 3/1998 Harding ..... 446/453
5,782,728 A * 7/1998 Morrison ..... 482/148
5,919,076 A * 7/1999 Abeyta ..... 446/50
6,366,869 B1 * 4/2002 Germain ..... 702/160
2004/0198148 A1 * 10/2004 Pittman ..... 446/220

* cited by examiner

*Primary Examiner*—Gregory L. Huson
*Assistant Examiner*—L. Amerson
(74) *Attorney, Agent, or Firm*—Harry M. Weiss; Weiss, Moy & Harris, P.C.

(57) ABSTRACT

A wheel-guiding device comprises a handle connected to a member of a U-shaped member and the handle is preferably essentially perpendicular to a plane of the U-shaped member for guiding the motion of a preferably wheel. The handle is extendable for adjusting the length of the wheel-guiding device. The wheel's motion is controlled with the wheel-guiding device by engaging the U-shaped member and pushing on the wheel with the wheel-guiding device causing the wheel to both rotate and move in various directions or to stop movement of the wheel.

1 Claim, 2 Drawing Sheets

WHEEL-GUIDING DEVICE AND METHODS OF USE THEREOF

FIELD OF THE INVENTION

This invention relates generally to devices for use as an amusement or during physical exercise, and more specifically to devices for wheel guiding and methods for controlling wheel movement thereof.

BACKGROUND OF THE INVENTION

In the past, various distractions have been available for people seeking an amusement or wanting to exercise and maintain a degree of less boredom. For example, head set radios and CD players are both commonly used by walkers and joggers, and free these people from the routine involved in their exercise. People commonly play games such as football, baseball, tennis and racquetball for physical exercise.

Currently, most joggers, walkers and runners do not include games during their activity. As a result, motivation for performing their activity is weakened. People, rather than going along paths may use relatively expensive exercise machines. It is desirable to have less expensive devices for exercise purposes that will engage the interest of people. A portable exercise device that can be adjusted for use by children or adults of various heights is also desirable.

In addition, people do not take advantage of other possibilities such as improving their hand and eye coordination, while continuing to maintain their physical activity. While sports activities provide the advantage of hand and eye coordination, they also require a level of skill that reduces the desirability of some people to pursue those sports. Therefore, there is a need for a product that can amuse people and can help people with lower degrees of skill and the desire to exercise without using exercise machines to do so and develop their motor skills.

For many people, exercise is a boring activity that becomes a task rather than being fun. Again, a device that provides the ability to engage people in mentally challenging activities, provide fun and promote physical activity would be of great benefit to many people. Chasing a wheel provides such an activity.

For the foregoing reasons, there is a need to provide devices for wheel guiding and methods for controlling wheel movement thereof.

SUMMARY OF THE INVENTION

Accordingly, it is an object of this invention to provide improved devices for wheel guiding.

It is a further object of this invention to provide improving devices for wheel guiding that are adjustable in dimension for use by people of different heights.

It is a further object of this invention to provide improving methods for controlling wheel movement with wheel-guiding devices.

PREFERRED EMBODIMENTS OF THE INVENTION

In accordance with one embodiment of this invention, a wheel-guiding device comprises in combination a handle and a U-shaped member connected to the handle for guiding motion of a wheel. The U-shaped member is preferably in the form of a U-shaped frame. The handle has an extension portion for adjusting the length of the wheel-guiding device. The handle is at an angle to a plane of the U-shaped member. The handle is at a right angle to a plane of the U-shaped frame. The wheel-guiding device further comprises a wheel coupled to the U-shaped member to control movement of the wheel. The wheel has a rim portion and an opening located within the rim portion.

In accordance with a second embodiment of this invention, a method of controlling movement of a wheel comprises providing a handle and a U-shaped member connected to the handle; and contacting a portion of the wheel with the U-shaped member for guiding motion of the wheel. The method further comprises the step of pushing an outer surface of the wheel with a portion of the U-shaped member to cause rotation and directional motion of the wheel. The method further comprises the step of surrounding the wheel with the U-shaped member for allowing free directional motion of the wheel. The method further comprises the steps of providing a hollow wheel; turning the handle to cause the U-shaped member to turn; inserting a portion of the U-shaped member inside the hollow wheel; and pushing the outer surface of the hollow wheel with a portion of the U-shaped member that is outside of the hollow wheel.

In accordance with a third embodiment of this invention, a method of controlling movement of a wheel comprises providing a handle and a U-shaped member connected to the handle; and contacting a portion of the wheel with the U-shaped member for guiding motion of the wheel. The method further comprises the steps of providing a hollow wheel; pushing an inner surface of the hollow wheel with a portion of the U-shaped member to cause rotation and directional motion of the hollow wheel. The method further comprises the steps of providing a hollow wheel; turning the handle to cause the U-shaped member to turn; and inserting the U-shaped member inside the hollow wheel. The method further comprises the step of looping a portion of the U-shaped member around the hollow wheel so that an inner portion of the U-shaped member remains inside the hollow wheel for pushing the inner surface of the hollow wheel.

In accordance with a fourth embodiment of this invention, a method of controlling movement of a wheel comprises providing a handle and a U-shaped member connected to the handle; and contacting a portion of the wheel with the U-shaped member for guiding motion of the wheel. The method further comprises the step of pulling on a portion of an outer surface of the wheel with a portion of the U-shaped member to cease wheel rotation. The method further comprises the steps of turning the handle to cause the U-shaped member to turn; and surrounding the wheel with the U-shaped member to both stop and pull the wheel. The method further comprises providing a hollow wheel; turning the handle to cause the U-shaped member to turn; inserting a portion of the U-shaped member inside the wheel; contacting a portion of an inner surface of the hollow wheel with the portion of the U-shaped member; and lifting the hollow wheel with the portion of the U-shaped member.

DESCRIPTION OF THE INVENTION

Figure 1:
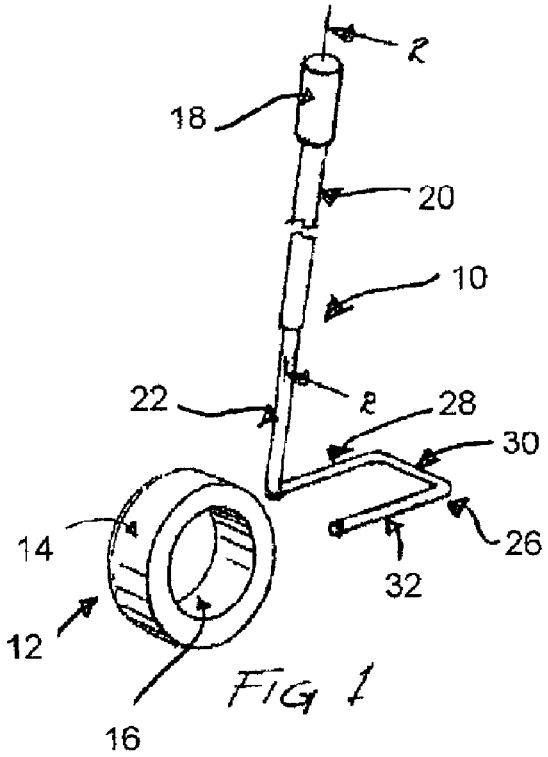
FIG. 1 is a perspective view of a wheel-guiding device and a hollow wheel where movement of the hollow wheel is provided by a U-shaped frame of the wheel-guiding device.

Referring to FIGS. 1, 4, 5, 6, 7 and 9 a wheel-guiding device 10 comprises a U-shaped frame 26 connected to a handle 22. The U-shaped frame 26 comprises a first member 28 essentially perpendicular to and adjacent to the handle 22 to form the first part of the U-shape. A second member 30 is adjacent to and co-planar with the first member 28, forming the second part of the U-shape. A third member 32 is adjacent to the second member 30 and co-planar with the first and second members 28, 30, forming the third part of the U-shape. While the length of the U-shape member 26 can be varied, in this embodiment a total length of about two feet is preferable.

According to FIG. 1, the handle 22 is at right angles to the U-shaped frame 26. However, the handle 22 may also be at a more acute or obtuse angle to the plane of the U-shaped frame 26. The term "essentially perpendicular" means that the handle 22 is at a right, acute or obtuse angle to the plane of the U-shaped frame 26, but not co-planar with U-shaped frame 26.

Figure 2:
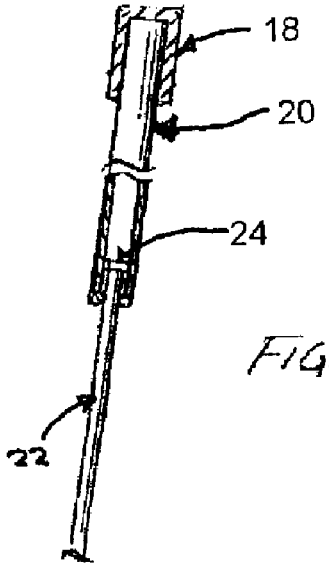
FIG. 2 is a cross-section through 2—2 of a handle of the wheel-guiding device of FIG. 1.

In FIGS. 1 and 2, in this embodiment, the handle 22 is extendable with an upper portion 20 of the handle 22 at an open end of the upper portion 20 of the handle 22 to allow for adjustment of the overall handle length for people of varying height. The upper portion 20 of the handle 22 has a moveable length adjustor 24 (FIG. 2) to stop the handle 22 at the appropriate length for the height of the person intending to use the wheel-guiding device 10. In addition, the upper portion 20 of the handle 22 has a knob 18 (FIGS. 1 and 2) that fits tightly over a closed end of the upper portion 20 of the handle 22 for gripping the wheel-guiding device 10. Therefore, the wheel-guiding device 10 is suitable for use by children and adults.

Figure 3:
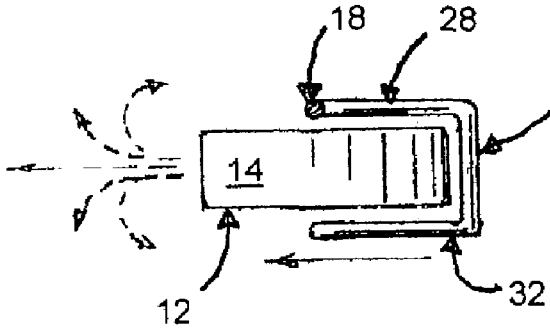
FIG. 3 is a downward view of the wheel-guiding device and the hollow wheel of FIG. 1, showing potential motion directions of the hollow wheel on use of the wheel-guiding device.

Referring to FIGS. 1 and 3, a hollow wheel 12 is shown surrounded by the U-shaped frame 26 between the frame members 28, 30 and 32. The diameter of the hollow wheel 12 may vary and is preferably about 1 foot in this embodiment. The hollow wheel 12 has an outer surface 14 and an inner surface 16. The hollow wheel 12 is caused to rotate in a forward motion by pushing the U-shaped frame 26 against the outer surface 14 of the hollow wheel 12 (FIG. 3). A person then continues to follow the motion of the hollow wheel 12 and apply a pushing force to continue its rotation.

FIG. 3 indicates potential directions of motion of the hollow wheel 12 when a member of the U-shaped frame 26 pushes the hollow wheel 12 on the outer surface 14 of the hollow wheel 12. The directions shown in FIG. 3 include straight, left, right or U-turns. In addition, circles can be made. These changes in motion are accomplished by manipulation of the hollow wheel 12 with the wheel-guiding device 10 on various parts of the hollow wheel 12, and by altering the angle at which the wheel-guiding device 10 meets the hollow wheel 12. The faster the wheel-guide device is used by following the hollow wheel 12, the quicker the hollow wheel 12 moves, increasing the rate of physical exercise. The wheel-guiding device 10 provides challenges for manipulation of the hollow wheel 12, while improving eye and hand co-ordination skills.

Figure 4:
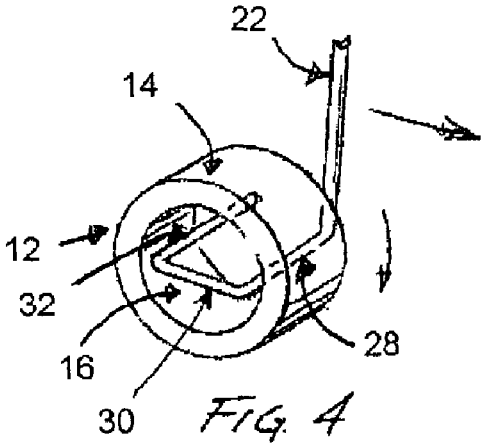
FIG. 4 is a perspective view of the wheel-guiding device and the hollow wheel of FIG. 1 where the U-shaped frame is inside the hollow wheel and contacts an inner surface of the hollow wheel to provide movement.
Figure 5:
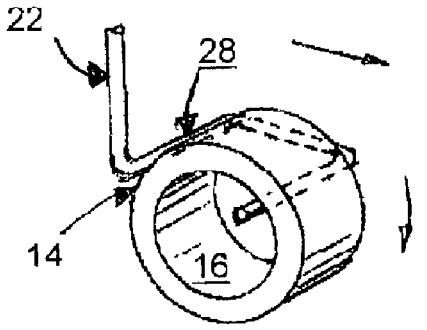
FIG. 5 is a perspective view of the wheel-guiding device and the hollow wheel of FIG. 1 where a member of the U-shaped frame is in contact with an outer surface of the hollow wheel to provide movement.
Figure 6:
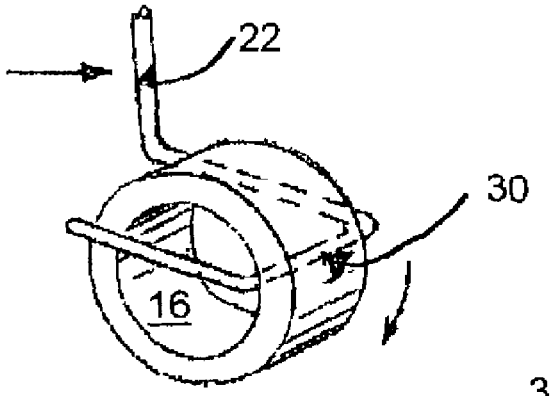
FIG. 6 is a perspective view of the wheel-guiding device and the hollow wheel of FIG. 1 where a member of the U-shaped frame is inside the hollow wheel and a member of the U-shaped frame is in contact with an inner surface of the hollow wheel to provide movement.

Referring to FIGS. 4, 5 and 6, alternative methods of manipulating the hollow wheel 12 illustrate how contact between a member of the U-shaped frame 26 and the outer surface 14 or the inner surface 16 of the hollow wheel 12 results in movement of the hollow wheel 12. In FIG. 4, the contact is between the first member 28 and the inner surface 16. In FIG. 5 the contact is between the first member 28 and the outer surface 14, and in FIG. 6 the contact is between the second member 30 and the inner surface 16. A pushing force of the handle 22 causes motion of the hollow wheel 12. For these embodiments, as shown in FIGS. 4, 5 and 6 contact is maintained between the hollow wheel 12 and the wheel-guiding device 10 during use, rather than allowing the hollow wheel 12 to move freely. An alternative embodiment of FIG. 4 allows for contact of the first member 28 at an edge of the inner surface 16 of the hollow wheel 12, rather than having the U-shaped frame 26 fully within the interior surface 16 of the hollow wheel 12. Similarly, an alternative embodiment of FIG. 5 allows for contact of the first member 28 at an outer edge 16 of the hollow wheel 12. In each case, the first member 28 (FIGS. 4 and 5) can be withdrawn from the edge of the inner surface 16 after each pushing motion, allowing the hollow wheel 12 to move freely.

Figure 7:
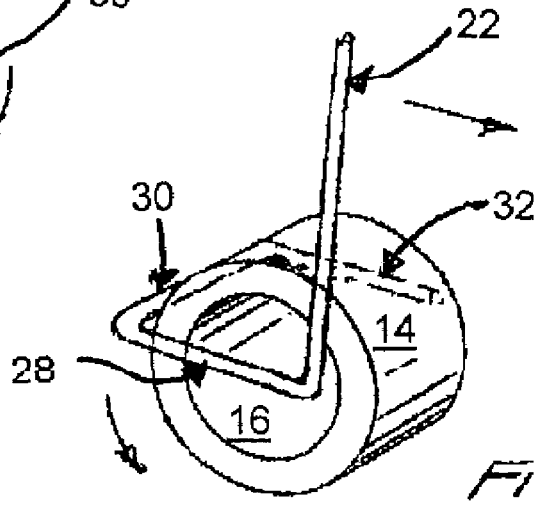
FIG. 7 is a perspective view of the wheel-guiding device and the hollow wheel of FIG. 1 where the hollow wheel is stopped from moving by the U-shaped frame of the wheel-guiding device of FIG. 1.
Figure 8:
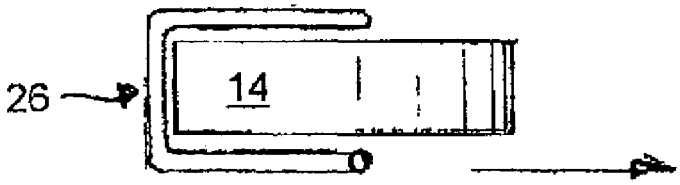
FIG. 8 is a downward view of the wheel-guiding device and the hollow wheel of FIG. 1 where the hollow wheel is stopped from moving by the U-shaped frame of the wheel-guiding device of FIG. 1.

Referring to FIGS. 7 and 8 motion of the hollow wheel 12 is stopped by contacting the outer surface 14 of the hollow wheel 12 with the second member 30 of the U-shaped frame 26. Greater control of the stopping motion is possible by contacting and surrounding the hollow wheel 12 between the members 28,30 and 32 of the U-shaped frame 26. Other methods of contact between the outer surface 14 of the hollow wheel 12 and the wheel-guiding device 10 for stopping motion of the hollow wheel 12 are possible.

Figure 9:
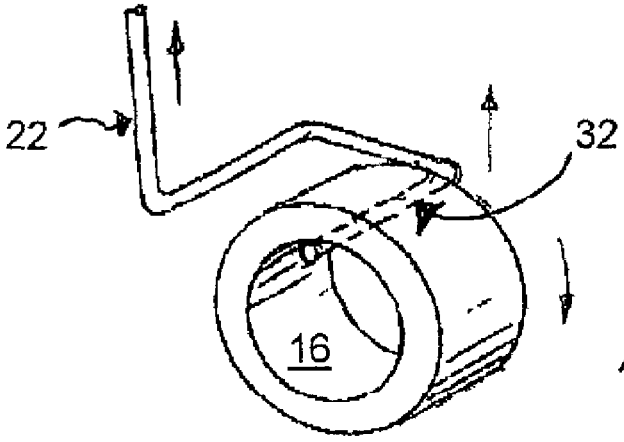
FIG. 9 is a perspective view of the wheel-guiding device and the hollow wheel of FIG. 1 where a member of the U-shaped frame contacts the inner surface of the hollow wheel and the handle is raised to stop movement by lifting up the hollow wheel.

In another embodiment of a method for stopping the hollow wheel 12, FIG. 9 illustrates the member 32 of the U-shaped frame 26 hooking the hollow wheel on the inner surface 16 of the hollow wheel 12, which is lifted by the upward motion of the handle 22 of the wheel-guiding device 10. Other methods of contact between the inner surface 16 of the hollow wheel 12 and the wheel-guiding device 10 for stopping motion of the hollow wheel 12 are possible.

In summary, the present invention is directed to a wheel-guiding device. A number of embodiments showing methods of controlling motion in various directions and stopping motion of the hollow wheel with wheel-guiding devices are described.

While the invention has been particularly shown and described with reference to preferred embodiments thereof, it will be understood by those skilled in the art that the foregoing and other changes in form and details may be made therein without departing from the spirit and scope of the invention.

For example, there are alternative methods by which the telescoping effect can be accomplished. The handle can be of fixed length and the wheel-guiding device would then be available in different fixed lengths. The materials of construction of the wheel-guiding device may be metals or plastics. The hollow wheel and the knob may be made of plastics or rubbers. Plastic materials may include those, which glow in the dark as a safety precaution. A small light may be attached to the wheel-guiding device as a safety precaution. Dimensions of components of the U-shaped frame may be altered to accommodate different hollow wheels. The methods of causing hollow wheels to move may differ. Hollow wheels may be replaced by solid wheels or other essentially round structures.

What is claimed is:

1. A method of controlling movement of a wheel comprising the steps of:

providing a wheel guiding device comprising a handle, said handle having an extension portion for adjusting the length of said wheel-guiding device to allow for adjustment of the length of said wheel-guiding device for people of varying height, and a U-shaped member comprising a first member connected to said handle, a second member adjacent to said first member, and a third member adjacent to said second member;

providing a hollow wheel;

contacting a portion of said hollow wheel with a portion of said U-shaped member;

guiding rotational and directional motion of said hollow wheel with said U-shaped member;

turning said handle to cause said U-shaped member to turn;

inserting a portion of said U-shaped member inside said hollow wheel;

pushing an outer surface of said hollow wheel with said first member of said U-shaped member, both said first member and said second member being outside of said hollow wheel, and said third member being inside said hollow wheel;

inserting a portion of said U-shaped member inside said hollow wheel;

pushing an inner surface of said hollow wheel with said first member of said U-shaped member to cause rotation and directional motion of said hollow wheel, a portion of said third member being inside said hollow wheel and making no contact with said inner surface of said hollow wheel;

turning said handle to cause said U-shaped member to turn;

inserting said U-shaped member inside said hollow wheel;

pushing said inner surface of said hollow wheel with said second member of said U-shaped member to cause rotation and directional motion of said hollow wheel; and looping a portion of said U-shaped member around said hollow wheel so that an inner portion of said U-shaped member remains inside said hollow wheel for pushing said inner surface of said hollow wheel.

* * * * *